US009677846B1

(12) United States Patent
Vankeuren, III

(10) Patent No.: US 9,677,846 B1
(45) Date of Patent: Jun. 13, 2017

(54) BULLPUP FIREARM CONVERSION SYSTEM

(71) Applicant: Lewis Karl Vankeuren, III, Galena, OH (US)

(72) Inventor: Lewis Karl Vankeuren, III, Galena, OH (US)

( * ) Notice: Subject to any disclaimer, the term of this patent is extended or adjusted under 35 U.S.C. 154(b) by 0 days.

(21) Appl. No.: 15/011,590

(22) Filed: Jan. 31, 2016

(51) Int. Cl.
*F41C 23/20* (2006.01)
*F41A 17/46* (2006.01)
*F41A 19/10* (2006.01)
*F41A 19/09* (2006.01)

(52) U.S. Cl.
CPC ..... *F41C 23/20* (2013.01); *F41A 17/46* (2013.01); *F41A 19/09* (2013.01); *F41A 19/10* (2013.01)

(58) Field of Classification Search
CPC ..... F41C 23/06; F41C 23/08; F41C 23/20; F41A 19/08–19/10; F41A 17/46
USPC ..... D22/108, 111
See application file for complete search history.

(56) References Cited

U.S. PATENT DOCUMENTS 3,488,488 A * 1/1970 Crouch ..... F41G 1/35 362/110
3,512,290 A * 5/1970 La Violette, Jr. ..... F41A 3/66 42/75.01
3,611,872 A * 10/1971 Davis ..... F41A 3/38 89/136
4,463,654 A * 8/1984 Barnes ..... F41A 19/09 42/74
4,601,123 A * 7/1986 Swearengen ..... F41A 11/02 42/70.01
4,663,876 A * 5/1987 Reaume ..... F41A 13/12 42/69.01
4,677,781 A * 7/1987 Lee ..... F41A 11/02 42/70.01
4,869,008 A * 9/1989 Rasmussen ..... F41A 19/09 42/69.01
6,543,173 B1 * 4/2003 Golan ..... F41A 19/09 42/75.04
7,356,958 B2 * 4/2008 Weir ..... F41A 19/00 42/42.02
7,493,718 B2 2/2009 Gorzen
D620,546 S * 7/2010 Fitzpatrick ..... D22/111
8,091,264 B2 * 1/2012 Goertz ..... F41A 19/10 42/1.11
D655,777 S * 3/2012 Burt ..... D22/108
8,615,915 B2 * 12/2013 Hunter ..... F41A 19/10 42/69.01
8,683,725 B2 * 4/2014 Munson ..... F41A 17/38 42/6
8,782,940 B1 * 7/2014 Morris ..... F41A 11/02 42/69.01

(Continued)

OTHER PUBLICATIONS

TheROOKvoice, The HTA 90/22 Installation, May 23, 2013, YouTube, https://www.youtube.com/watch?v=Hp46KBQXRak.*

(Continued)

*Primary Examiner* — Stephen M Johnson
*Assistant Examiner* — Joshua Semick
(74) *Attorney, Agent, or Firm* — Ronald J Koch

(57) ABSTRACT

A firearm bullpup conversion system incorporates a uniquely configured buttstock that conforms to the operator's shoulder or upper arm to reduce the pull length for a given overall stock length. The system also provides for an auxiliary trigger located in front of the action, an integrated cocking and accessory mounting rail, and a trigger safety.

2 Claims, 6 Drawing Sheets

(56) References Cited

U.S. PATENT DOCUMENTS

| | | | | |
|---|---|---|---|---|
| 9,015,981 | B2 * | 4/2015 | Zamlinsky | F41C 23/20 42/75.01 |
| 9,109,856 | B1 | 8/2015 | Zamlinsky | |
| 9,115,954 | B1 * | 8/2015 | Corsi | F41C 7/02 |
| 2006/0048430 | A1 * | 3/2006 | Crandall | F41A 9/47 42/71.01 |
| 2013/0185975 | A1 * | 7/2013 | Johnson | F41A 19/09 42/69.02 |
| 2014/0075803 | A1 * | 3/2014 | Muller | F41A 11/02 42/16 |
| 2014/0075812 | A1 * | 3/2014 | Johnson | F41A 19/08 42/69.01 |
| 2015/0107143 | A1 * | 4/2015 | Coetzee | F41G 11/003 42/14 |

OTHER PUBLICATIONS

AKLYSdefense, Aklys Defense ZK-22 Ruger 10/22 bullpup conversion stock Installation, Jan. 6, 2013, YouTube, https://www.youtube.com/watch?v=9Ud1RJ3p2YM.*

* cited by examiner

BULLPUP FIREARM CONVERSION SYSTEM

BACKGROUND AND SUMMARY

This invention relates generally to firearms, and more particularly to stock or conversion kits (a.k.a. "bullpup stock kit", "bullpup stock system") which convert a traditional firearm into bullpup configurations.

Firearm "bullpup" configurations are discussed in some detail in Wikipedia, some portions paraphrased, summarized, and or quoted herein. Traditionally, firearms using detachable magazines are configured so that fee action of the firearm and fee ammunition magazine are located in front of the trigger. Firearms configured so that the action and the magazine are located behind the trigger of fee firearm are generally referred to as "bullpups".

Bullpup configuration permits a shorter overall weapon for a given barrel length. This is due to the positioning of the action closer to the rear end of the buttstock. This maintains the advantages of a longer barrel in muzzle velocity and accuracy, while improving maneuverability and reducing weight.

Traditional firearms users may desire to alter the appearance and function of their more traditionally configured firearm into that of a bullpup for various reasons, including but not limited to improve ergonomics, reduce weight, and reduce overall length without compromising ballistic performance. There is a need for a conversion system that minimizes the requisite expertise and mechanical skill.

In converting a firearm to bullpup configuration, the action and the mounting position of the ammunition magazine are moved rearward relative to the butt, but the desired position of the trigger relative to the butt stays the same. This requires the bullpup stock kit to include a mechanism that places an auxiliary trigger relatively in front of the action and in operational communication with the firearm's original trigger (aka the trigger of a barreled action). The foregoing is usually accomplished with a rigid push-rod type linkage mechanism. The trigger pull characteristics of these mechanisms is generally considered inferior to the trigger pull characteristics of the host firearm. The present invention achieves an advantage over existing systems by providing a tension-type trigger linkage mechanism utilizing a cable.

One handed operation is desirable. The compact design of the bullpup configuration entices users to attempt one handed operation. However, traditional bullpup designs are problematic in that the pull length is too long for efficient one-handed operation. "Pull length" is generally defined as the distance from the center of the buttstock to the trigger. Thus, it is an object of this invention to reduce the pull length.

An advantage of the present invention is achieved by providing a uniquely designed buttstock resulting in a reduced pull length; a forwardly sloping butt design achieves a shorter pull length by allowing the upper portion of the butt to rest on the shoulder or upper arm of the user, thus improving one-handed operation.

Due to the rearward placement of the firearm action relative to the butt in a bullpup configured firearm, a mechanism that places an auxiliary cocking handle forward of the action and in operational communication with the firearm's original cocking handle is a desirable feature. Also, due to the rearward placement of the firearm action relative to the butt in a bullpup configured firearm, the original sights cannot be used. Thus, it is desirable to provide auxiliary sights or an attachment platform for auxiliary sights.

Another advantage is achieved by connecting the auxiliary sights and/or the attachment platform for the auxiliary sights directly to the firearm receiver, because doing so provides a more stable and therefore accurate arrangement.

Yet another advantage is achieved by combining the aforementioned auxiliary cocking handle and attachment platform for auxiliary sights into an assembly that is connected directly to the receiver. This arrangement achieves the aforementioned advantages as well as requiring less volume and mass than would be needed for the separate components.

In the various embodiments described, the present invention is advantageous in that it requires minimal gunsmithing knowledge or mechanical expertise to install, provides a configuration that conforms to the shoulder or upper arm and places the firearm action close to the body and shortens the pull length, provides an auxiliary trigger forwardly positioned in front of the action and the magazine, provides a an auxiliary cocking handle forwardly positioned in front of the action, and provides a stable mounting platform for auxiliary sights.

In one embodiment, a bullpup conversion system comprises, a grip adapted to be gripped by a user in such a way so as to allow the user to engage an auxiliary trigger; a trigger linkage mechanism operatively engaging the auxiliary trigger and a first trigger of a barreled action, wherein the linkage mechanism includes a cable; the grip and auxiliary trigger being located in front of the barreled action; a trigger safety for restraining the auxiliary trigger in a non-firing position; a butt having a rearwardly oriented surface adapted to conform to the upper surface of the operator's shoulder-upper arm region; a sight and/or scope accessory mounting rail; a cocking handle linkage mechanism having an auxiliary cocking handle for operatively engaging a first cocking handle; wherein the sight and/or scope accessory mounting rail and cocking handle linkage mechanism comprise an assembly (aka a combined system); the foregoing enclosed within a two piece chassis system. It is to be understood that the term "chassis", as used herein, is interchangeable with, and in the nature of, an "enclosure" and thus is not limited in meaning to a frame or subframe.

In one embodiment, the present invention is configured to work with a Ruger 10/22 rifle ("Ruger" and "10/22" are trademarked). Accordingly, those of skill in the art will appreciate that the various components described herein are sized accordingly. In one embodiment, a bullpup conversion system comprises, left and right chassis portions configured to receive the barreled action of a rifle (e.g. Ruger 10/22 rifle).

In one embodiment, the rear portion of the chassis comprises a butt with a concave contoured surface that is angled forward from top to bottom. This configuration allows the rear end of the stock to rest on the upper surface of the operator's shoulder or arm and also reduces the pull length, over traditional butt designs for a given overall stock length. A rail is secured to the top of the receiver using a connector plate that is secured to the factory installed scope mount holes. The rail provides a mechanism that connects auxiliary cocking levers on either side of the rail to the cocking handle on the barreled action. By operating either auxiliary cocking handle, the cocking handle on the barreled action may be operated.

It is to be understood that the term "action" as used herein throughout includes the bolt, receiver and trigger mechanism of the firearm. The firearm used in some embodiments is a Ruger 10/22 rifle, commonly referred to as a 10/22. The 10/22 is typically chambered to fire .22 Long Rifle caliber ammunition.

As described herein, the present invention is directed towards a firearm stock kit that may be used to convert a traditionally configured firearm into bullpup configuration. The stock incorporates a uniquely configured buttstock that conforms to the operator's shoulder or upper arm and reduces the pull length for a given overall stock length. The firearm stock kit also provides for an auxiliary trigger, an integrated cocking and accessory mounting rail, and a trigger safety. Those of skill in the art will appreciate other objects and advantages in addition to those described herein.

BRIEF DESCRIPTION OF THE DRAWINGS

It is to be expressly understood that the drawings are for the purpose of illustration and description only and are not intended as a definition of the limits of the invention.

REFERENCE NUMERALS IN DRAWINGS

Figure 1:
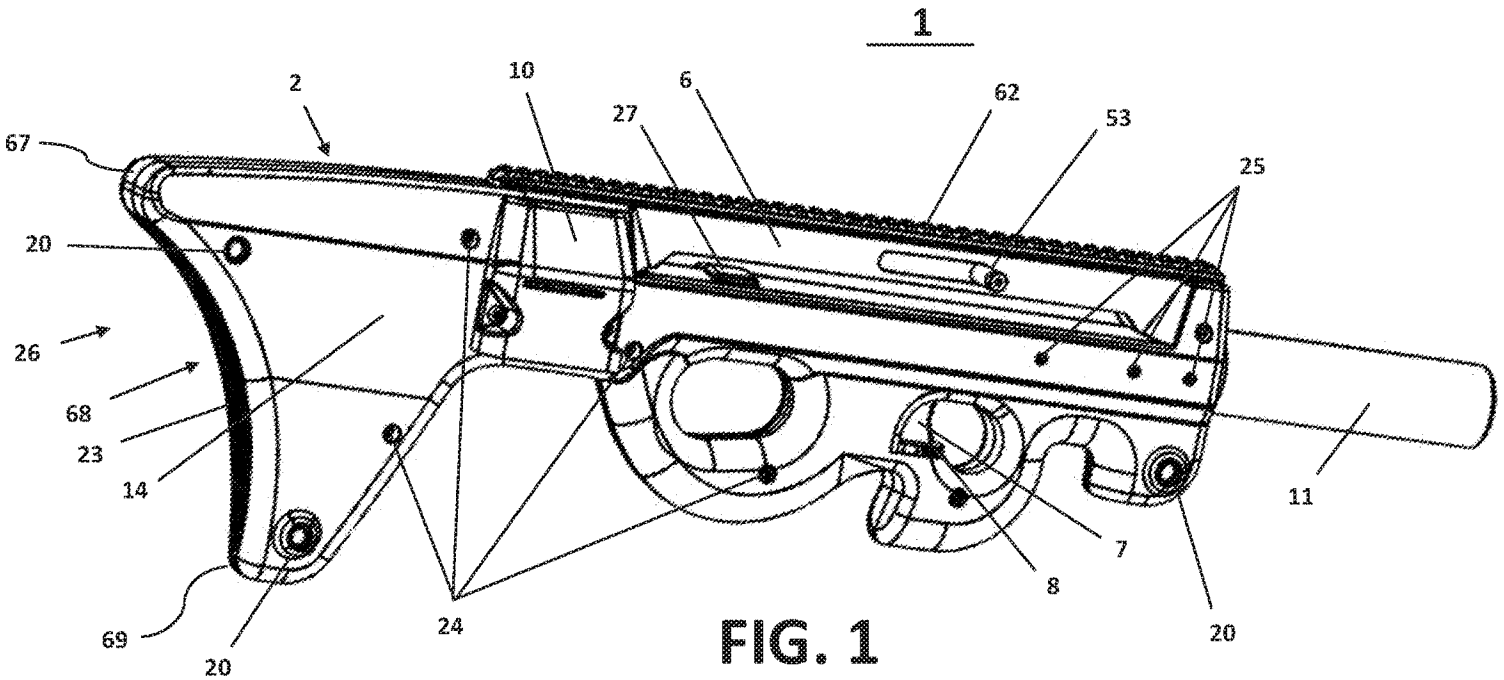
FIG. 1 is a side perspective view of the right side of a 10/22 rifle's barreled action equipped with a bullpup stock kit in accordance with the present invention.

The table below lists the reference numerals employed in the figures, and identifies the element designated by each numeral.

1 Bullpup configured rifle
2 Bullpup Stock Kit
3 Barreled action
4 Left Stock Body portion
5 Right Stock Body portion
6 cocking/accessory rail
7 auxiliary trigger
8 auxiliary trigger safety
9 trigger linkage mechanism
10 Shell Casing Deflector
11 Barrel Shroud
12 Barrel Shroud—Left half
13 Barrel Shroud—Right half
14 chassis
15 Action
16 Barrel
17 10/22 trigger
18 Trigger Housing
19 Internal rib in chassis
20 Sling attachment point
21 Sling attachment point—left portion
22 Sling attachment point—right portion
23 Shark fin buttstock
24 chassis screw
25 accessory threaded insert
26 butt
27 10/22 rear sight channel
28 10/22 rear sight
29 trigger support plate
30 trigger pivot pin
31 linkage cable
32 trigger cable hole
33 cable set screw
34 cable block
35 trigger slide bar
36 slide bar cable screw
37 mounting screw
38 slide bar retaining plate
39 trigger actuating pin
40 trigger spring
41 trigger spring screw
42 cable tensioner
43 cable tension pin
44 tension spring
45 tension spring screw
46 trigger block
47 safety pivot screw
48 safety detent pin
49 detent spring
50 support plate mounting screws
51 rail body
52 cocking bar
53 cocking handle
54 cocking handle screw
55 cocking handle screw insert
56 cocking spur
57 cocking spur screws
58 cocking bar spring
59 cocking bar spring screw
60 10/22 receiver
61 key plate
62 accessory rail
63 key plate opening
64 10/22 cocking handle
65 shell deflector screws
66 cable tensioner frame
67 butt upper portion
68 butt middle portion
69 butt lower portion

DETAILED DESCRIPTION

Figure 2:
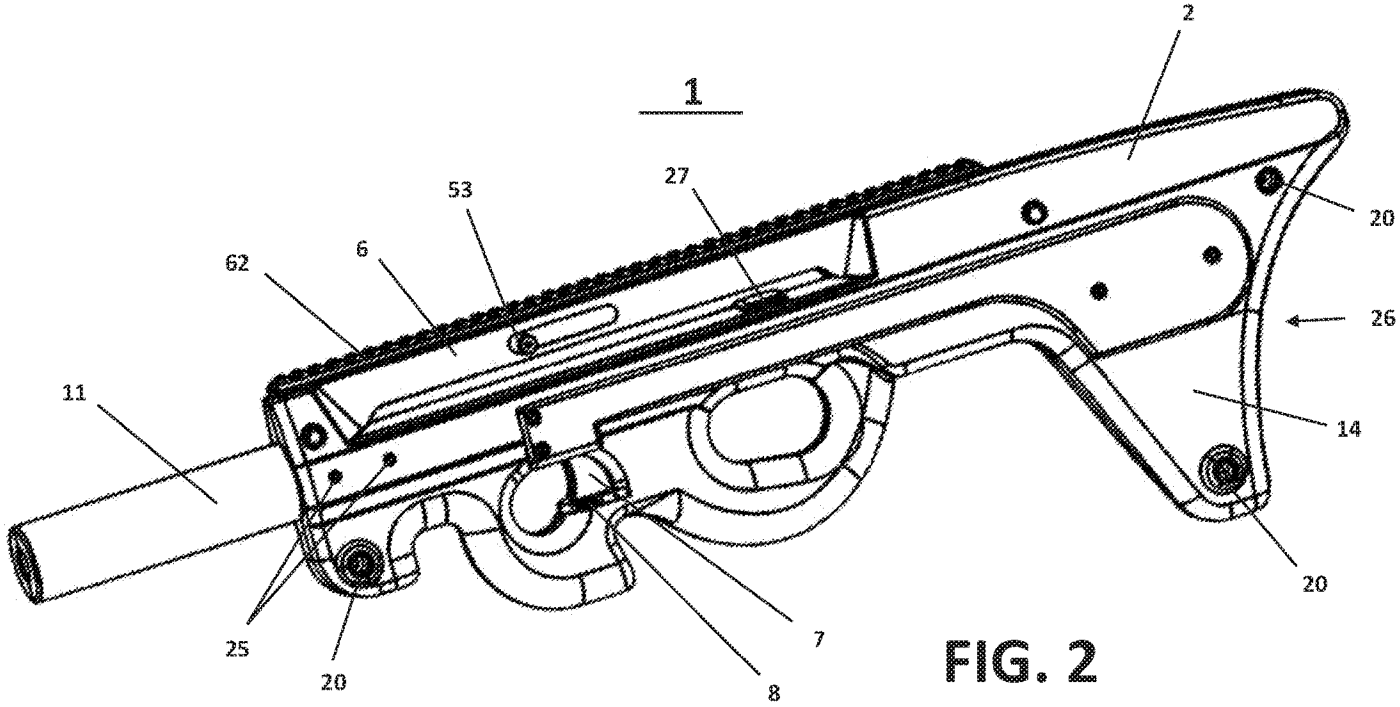
FIG. 2 is a side perspective view of the left side of the bullpup-configured firearm shown in FIG. 1.

Turning now to the drawings in which like reference characters indicate corresponding elements throughout the several views, as used herein, the word "front" or "forward" corresponds to where the muzzle end of the barrel is located (i.e., to the right as shown in FIGS. 1, and 3 through 6, and to the left in FIG. 2); "rear" or "rearward" or "back" corresponds to the direction opposite where the muzzle end of the barrel is located (i.e., to the left as shown in FIGS. 1, and 3 through 6, and to the right in FIG. 2).

Figure 3:
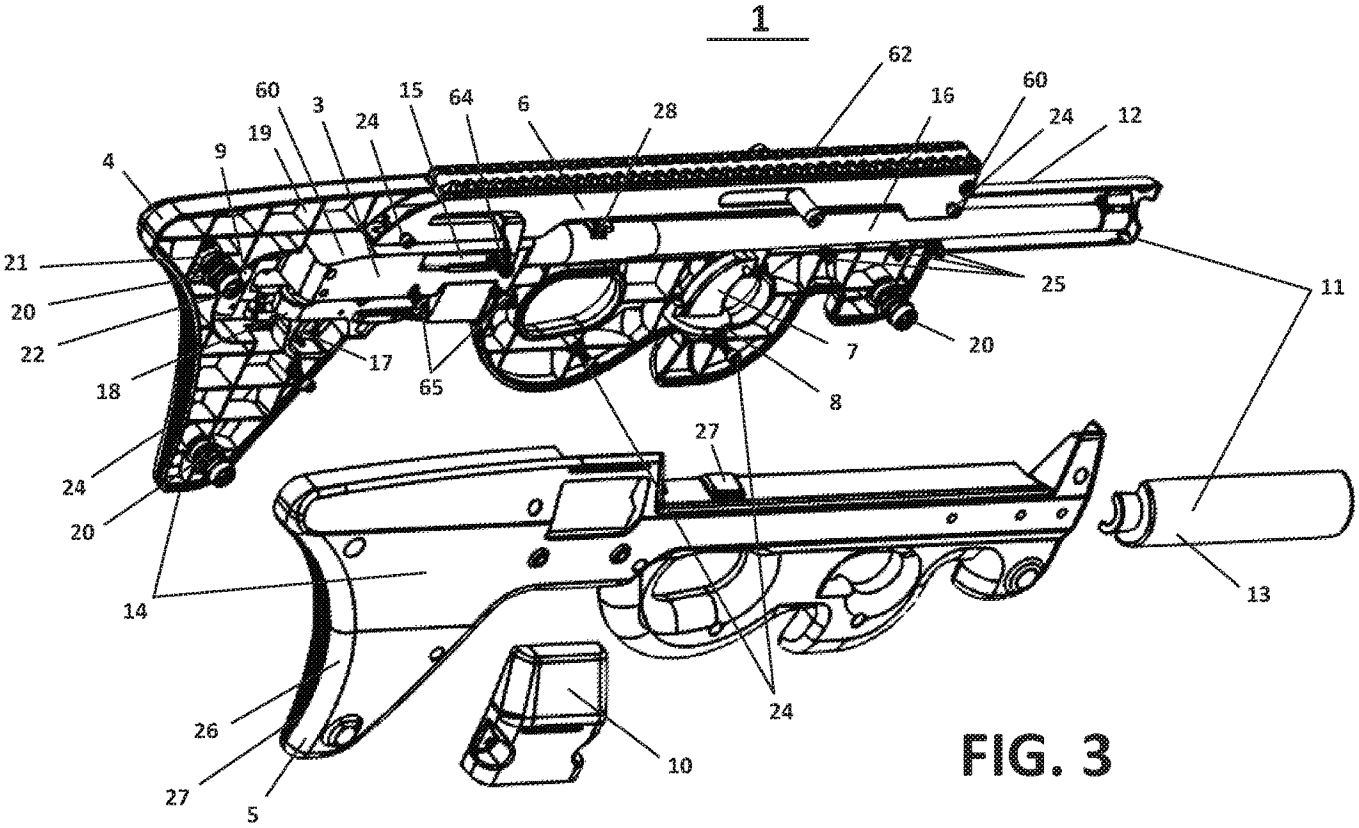
FIG. 3 is an exploded view showing the internal arrangement of the bullpup-configured firearm shown in FIGS. 1 and 2.

As shown in FIGS. 1-3, the present invention is directed to a bullpup stock kit, designated by reference numeral 2, for use with the barreled action 3 of a rifle. The combination of the barreled action 3 and the bullpup stock kit 2 is referred to as the bullpup configured firearm, or simply bullpup, and is designated by reference number 1.

Best shown in the exploded view of FIG. 3, the bullpup stock kit 20 comprises a left stock body portion 4, a right stock body portion 5 (aka left and right chassis portions), a cocking/accessory rail 6, auxiliary trigger 7, auxiliary trigger safety 8, a trigger linkage mechanism 9, a shell casing deflector 10, and a barrel shroud 11 that comprises a left shroud portion 12 and a right shroud portion 13. The combination of the left stock body portion 4 and the right stock body portion 5 are collectively referred to herein as the chassis 14. Also shown in FIG. 3 is a detailed view of a Ruger 10/22 barreled action 3. The barreled action 3 is comprised of an action 15 (receiver and bolt) and a barrel 16. The action 15 also has a trigger 17, and a trigger housing 18.

FIGS. 1 through 3 show detailed illustrations of the chassis 14. In the preferred form, the chassis 14 is injection molded from a stiff, resilient polymer, though the particular material is not essential to the present invention. The chassis 14 includes internal ribs 19 that provided structural support for the outside surface of the chassis 14 and also support the barreled action 3, the trigger linkage mechanism 9, and the cocking/accessory rail 6. The chassis 14 has sling attachment points 20. In the preferred embodiment, the sling attachment points are machined from 6061 T6 aluminum and are of the quick-disconnect socket type. The sling attachment points 20 consist of a left portion 21 and a right portion 22 that are molded into the left stock body portion 4 and the right stock body portion 5, respectively. The left portion 21 and the right portion 22 of the sling attachment points 20 are connected in the middle by means of a screw (not shown) and thus help secure the left stock body portion 4 and the right stock body portion 5 together. The left stock body portion 4 and the right stock body portion 5 are further secured together by means of chassis screws 24 and threaded inserts (not shown). In the preferred form, the chassis also includes threaded inserts 25 for the attachment of accessory rails.

FIGS. 1 through 3 show detailed illustrations of the chassis' 14 butt area 26. The surface of the butt 23 has a ribbed texture which prevents the bullpup 1 from slipping off of the operator's shoulder or upper arm during firing. The butt 26 is configured so that it is angled forward from top to bottom. This arrangement has two advantages over traditionally configured butts. The first advantage is to allow the butt 26 of the bullpup 1 to rest on top of the user's shoulder or upper arm to facilitate one-handed operation of the bullpup 1. The second advantage is to reduce the distance from the center of the butt 26 to the auxiliary trigger 7, commonly referred to as the length of pull (or pull length), for a given overall chassis length. This allows the center of mass of the bullpup 1 to be held closer to the user's body when it is shouldered.

FIGS. 1 through 3 also show the 10/22 rear sight channel 28 in the chassis 14. The 10/22 rear sight channel 28 allows the factory rear sight 29 to remain in place on the barrel 16 when the barreled action 3 is installed in the chassis 14. Those of skill in the art will appreciate that such channel is sized commensurate with a given sight (e.g. 10/22).

FIGS. 1 through 3 show detailed illustrations of the shell deflector 10 and the barrel shroud 11. The shell deflector 10 is secured to the chassis 14 with screws and inserts 65. The rearward end of the barrel shroud 11 is sandwiched between the left stock body portion 4 and the right stock body portion 5 during assembly of the bullpup configured firearm 1. In the preferred form, the shell deflector 10 and barrel shroud 11 are injection molded from a stiff, resilient polymer, though the particular material is not essential to the present invention.

Figure 4:
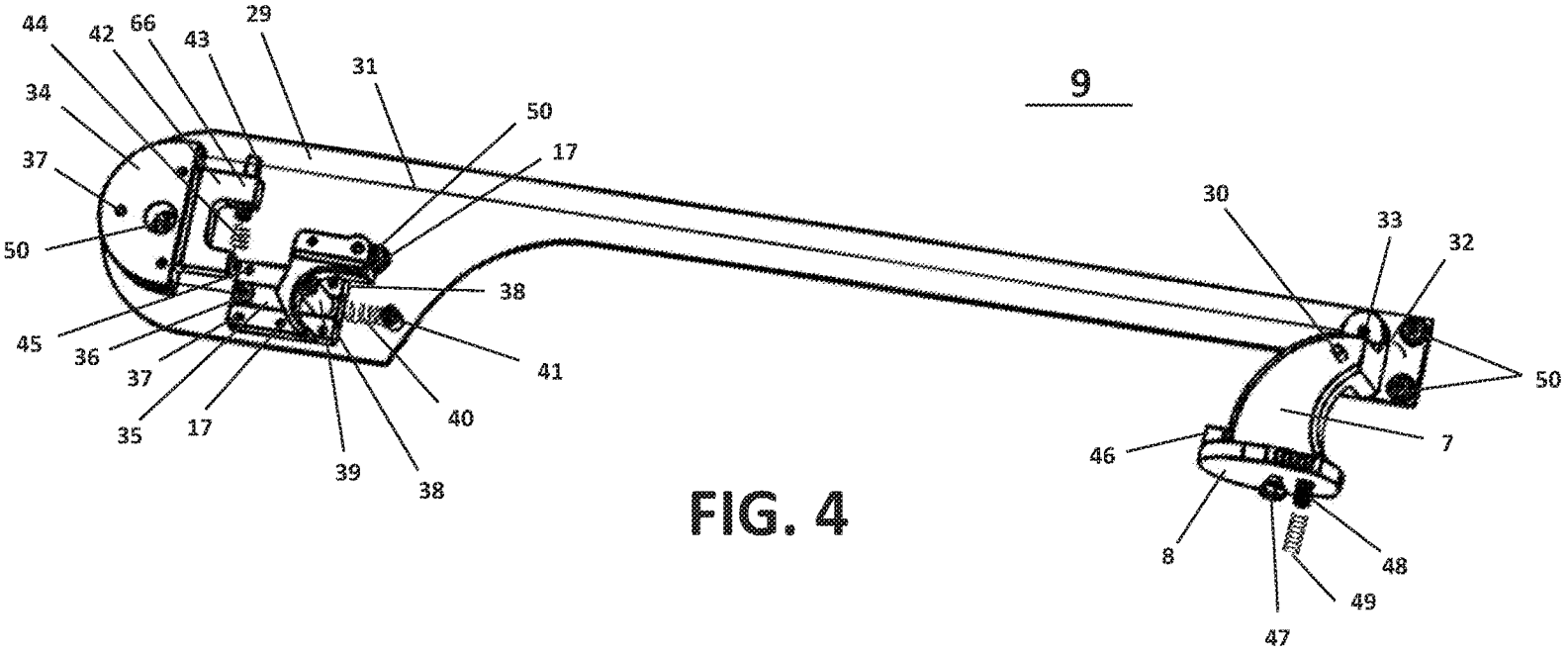
FIG. 4 is a side perspective view of the right side of the bullpup stock kit trigger linkage mechanism and safety.

FIG. 4 shows details of the trigger linkage mechanism 9. The trigger linkage mechanism 9 is comprised of the following assembly: the auxiliary trigger 7 is attached to the support plate 29 by means of a pivot pin 30; a linkage cable 31 is attached to the top of the auxiliary trigger 7 through a hole 32 and secured with a set screw 33; the linkage cable extends to the rear of the support plate 29, passes around the cable block 34, and is secured to the end of the trigger slide bar 35 by means of a screw 36; the cable block 34 is secured to the support plate with mounting screws 37; the trigger slide bar is supported on either side by retaining plates 38 secured to the support plate with mounting screws 37; and, the trigger actuating pin 39 is located at the forward end of the trigger slide bar 35 in close proximity to the surface of the trigger 17. The auxiliary trigger 7 and trigger slide bar 35 are retained in a forward position by means of a trigger spring 40 that is connected between the trigger actuating pin 39 and the support plate 29 by means of a screw 41. A cable tensioner 42 comprises a frame 66 machined into the front side of the cable block 34 that houses a cable tension pin 43 which encircles the linkage cable 31 at one end and is connected to the tension spring 44 at the other. The tension spring 44 is in turn connected to the frame 66 with the tension spring screw 45. The trigger linkage mechanism 9 also includes auxiliary trigger safety 8 that prevents rearward movement of the auxiliary trigger 7 by means of the trigger block 46 that protrudes from the top surface of the auxiliary trigger safety 8. The safety is mounted to the chassis 14 by means of the safety pivot screw 47. The auxiliary trigger safety 8 is retained in either the "on" or "off" position by means of a pin 48 and a spring 49 that are mounted in the chassis below the auxiliary trigger safety 8. The trigger linkage mechanism 29 is secured to the left stock body portion 4 using the support plate mounting screws 50.

Operation of the trigger linkage mechanism 9 is as follows: rearward pressure on the auxiliary trigger 7 places tension on the linkage cable 31; the linkage cable 31 pulls the trigger slide bar 36 rearward; the trigger actuating pin 39 contacts and moves trigger 17 rearward which in turn fires the bullpup configured firearm 1. Rotation of the auxiliary trigger safety 8 in a counterclockwise motion (as viewed from the top) moves the trigger block 46 into position and prevents rearward movement of the auxiliary trigger 7.

In the preferred form, the auxiliary trigger 7, auxiliary trigger safety 8, support plate 29, cable tension pin 43, and slide bar retaining plates 38 are machined from 6061 T6 aluminum, the cable block 34 and trigger slide bar 35 are machined from Delrin, and the linkage cable 31 is Kevlar or stainless steel, though the particular materials are not essential to the present invention.

Figure 5:
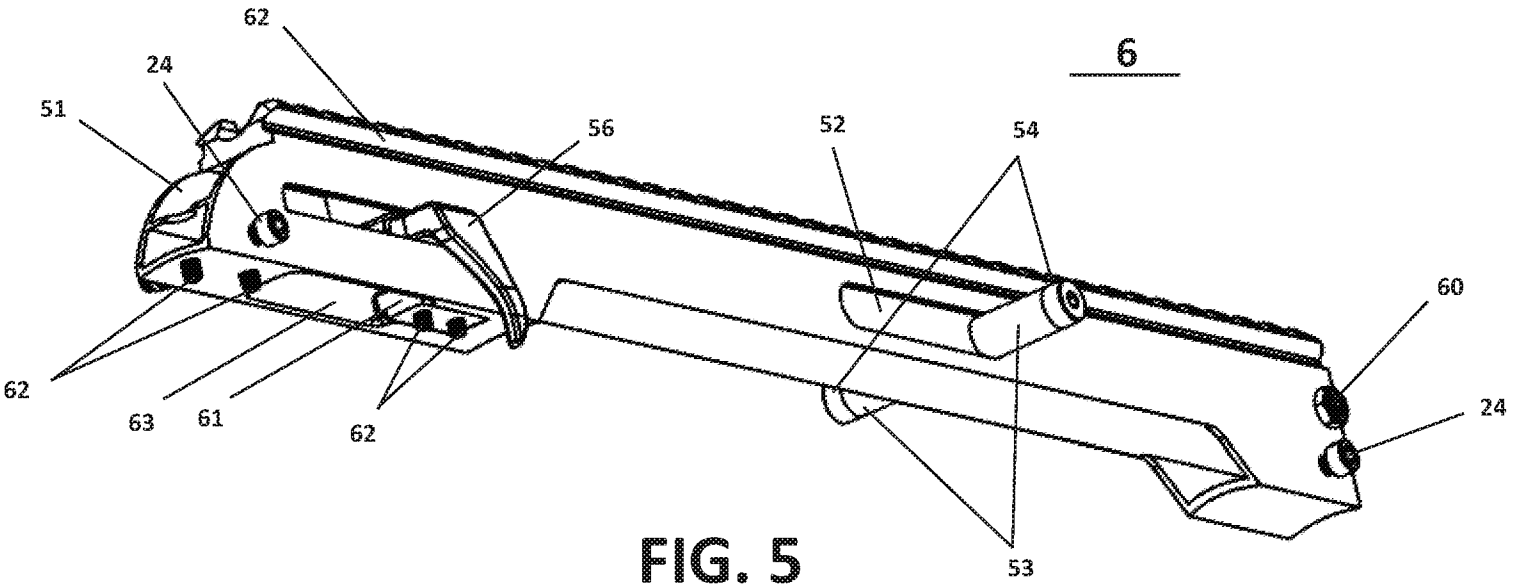
FIG. 5 is a side perspective view of the right side of the bullpup stock kit cocking/accessory rail mechanism.
Figure 6:
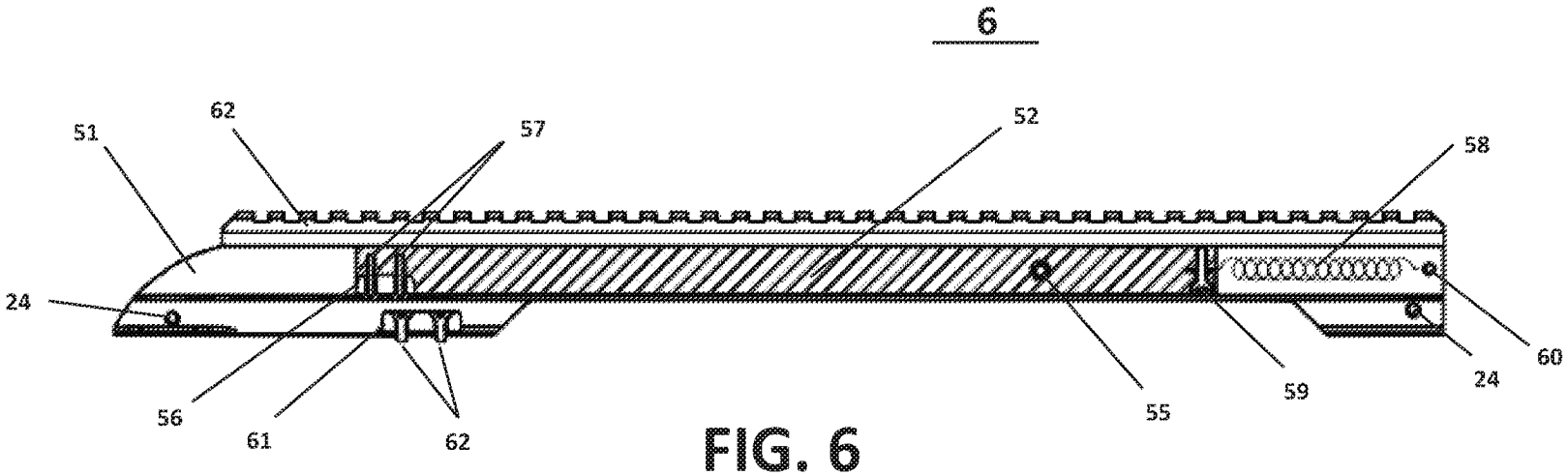
FIG. 6 is a side cutaway view of the right side of the bullpup stock kit cocking/accessory rail mechanism.

FIGS. 5 and 6 show details of the cocking/accessory rail 6. The cocking/accessory rail 6 is comprised of the following assembly: the rail body 51 houses the cocking bar 52; the cocking handles 53 are secured to the cocking bar with the cocking handle screws 54 that are connected at the center of the cocking bar by the cocking handle screw insert 55; the cocking spur 56 is connected the rearward end of the cocking bar 52 with screws 57. The cocking bar 52 is retained in a forward position by the cocking bar spring 58. The rearward end of the cocking bar spring 58 is connected to the forward end of the cocking bar 52 by a screw 59. The forward end of the cocking bar spring 58 is connected to the forward end of the rail body 51 by a nut and bolt 60. The rail body 51 is connected to the 10/22 receiver 60 using: the factory installed scope mounting holes (not shown); a key plate 61; and mounting screws 62. The rail body 51 has an accessory rail 62 along the top surface that facilitates the attachment of sights, scopes, lasers, flashlights, or other items ancillary to operation of the bullpup firearm 1. In the illustrated embodiment the accessory rail is of the type generally referred to as a "Picatinny rail" and manufactured in accordance with the specifications in MIL-STD-1913. Other attachment surfaces which facilitate the attachment of optics and iron sights could be used in place of the accessory rail shown and described herein.

In the preferred embodiment, the rail body 51 is machined from extruded 6061 T6 aluminum stock, the cocking bar 52 is machined from Delrin, and the cocking spur 56 is machined from 6061 T6 aluminum, though the particular materials are not essential to the present invention.

The cocking/accessory rail 6 is attached to the 10/22 receiver 60 as follows: the key plate 61 is attached to the forward most two factory installed mounting holes on the 10/22 receiver 60 using screws 62; the cocking/accessory rail 6 is positioned on top of the 10/22 receiver 60 such that the key plate extends through the wide part of the key plate opening 63 in the rail body 51; the cocking accessory rail is slid toward the rear until the key plate 61 is fully engaged in the narrow part of the key plate opening 63; and, the cocking/accessory rail 6 is secured in position on the 10/22 receiver 60 using the rearward most two factory installed mounting holes (not shown) and screws 62.

Operation of the cocking/accessory rail is as follows: The cocking handle 54 is pulled to the rear which in turn pulls the cocking bar 52 to the rear; the cocking spur 56 that is connected to the rear end of the cocking bar 52 engages and moves the 10/22 cocking handle 64 rearward which in turn operates the 10/22 action 15.

Assembly of the complete Bullpup configured firearm 1 comprises the following steps: The trigger linkage mechanism 9 is secured into the left stock body portion 4; the cocking/accessory rail 6 is attached to the top of the barreled action 3 as described above; the barreled action 3 and cocking accessory rail 6 combination is positioned into the left stock body portion 4; the right stock body portion 5 is placed over the left stock body portion 4 and secured with the chassis screws 24.

The exact shape of the chassis 14 exterior surfaces may be varied without departing from the scope of the invention disclosed herein.

In an alternate embodiment, the barrel shroud 11 could be omitted entirely without departing from the spirit of the present invention. In lieu of the barrel shroud 11, a flush bushing (not shown) located at the barrel opening in the chassis 14 could replace it.

In still another alternate embodiment, iron sights could be provided as part of the cocking/accessory rail 6 without departing from the scope of the present invention.

In yet another alternate embodiment, the shell casing deflector 10 could be omitted from the bullpup configured firearm 1 without departing from the scope of the present invention.

The foregoing descriptions and drawings should be considered as illustrative only of the general principles of the invention. This invention is not limited for use with the barreled actions of Ruger 10/22 rifles; rather it may be used with any firearm's barreled action which has similar operating features and dimensions. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

In one embodiment, left and right stock body portions 4, 5 are fitted together so as to form a case having butt portion 26. Butt portion 26 has rearwardly oriented surface (middle portion 68, upper portion 67, and lower portion 69) adapted to conform to and engage the user's shoulder-upper arm region.

In one embodiment (e.g. FIGS. 1-3), lower portion 69 is relatively forward of upper portion 67, and middle portion 68 is concave—relative to the user's shoulder.

What is claimed is:

1. A bullpup conversion system comprising:

a trigger linkage adapted to operatively engage a trigger of a barreled action to an auxiliary trigger, wherein the linkage includes a cable;

a grip adapted to be gripped by a user in such a way so as to allow the user to engage the auxiliary trigger;

the grip and auxiliary trigger being located in front of the barreled action;

an accessory mounting rail adapted to receive a sight and/or scope mounted thereto;

a cocking handle linkage adapted to operatively engage a cocking handle of the barreled action to an auxiliary cocking handle, the auxiliary cocking handle being located in front of the cocking handle;

a left stock body portion and a right stock body portion fitted together so as to form a case having a butt portion, the butt portion having a rearwardly oriented surface adapted to conform to and engage a user's shoulder-upper arm region;

the cocking handle linkage operatively connected to a top surface of a receiver of the barreled action.

2. The bullpup conversion system of claim 1 further comprising:

the cocking handle linkage operatively connected to a top surface of a receiver of the barreled action via an attachment member.

* * * * *